United States Patent [19]

Morris

[11] 4,102,456

[45] Jul. 25, 1978

[54] KIT FOR THREE-DIMENSIONAL PLASTIC OBJECTS

[75] Inventor: Betty Jean Morris, Brookfield, Wis.

[73] Assignee: K & B Innovations, Inc., Brookfield, Wis.

[21] Appl. No.: 761,409

[22] Filed: Jan. 21, 1977

[51] Int. Cl.[2] ..... B65D 69/00

[52] U.S. Cl. ..... 206/575; 35/26; 156/59; 156/84

[58] Field of Search ..... 206/575; 35/26; 156/59, 156/84

[56] References Cited

U.S. PATENT DOCUMENTS

| | | | |
|---|---|---|---|
| 3,283,419 | 11/1966 | Tytel | 35/26 |
| 3,492,143 | 1/1970 | Oberg | 35/26 |
| 3,553,855 | 1/1971 | Oberg | 35/26 |
| 3,975,223 | 8/1976 | Turoff | 35/26 |

*Primary Examiner*—William Price

*Assistant Examiner*—Joseph M. Moy

*Attorney, Agent, or Firm*—Quarles & Brady

[57] ABSTRACT

A kit is provided for practicing a method of preparing novel, three-dimensional objects of plastic material. The method comprises forming an object from shrinkable plastic sheeting, a portion of which object is provided with a decorative coat of particulate material such as flocking; heating said object sufficiently to cause the plastic to shrink but not flow whereupon the portion of the plastic covered with the coat of particulate material bulges or puffs outwardly, then cooling the object to harden the plastic and to obtain a novel three-dimensional object. The kit may include shrinkable plastic sheeting which already has a portion coated with a decorative particulate material or alternatively it may include uncoated shrinkable plastic sheeting, a supply of a decorative particulate material such as rayon flocking and, if necessary, means for attaching the particulate material to the plastic sheeting.

4 Claims, 6 Drawing Figures

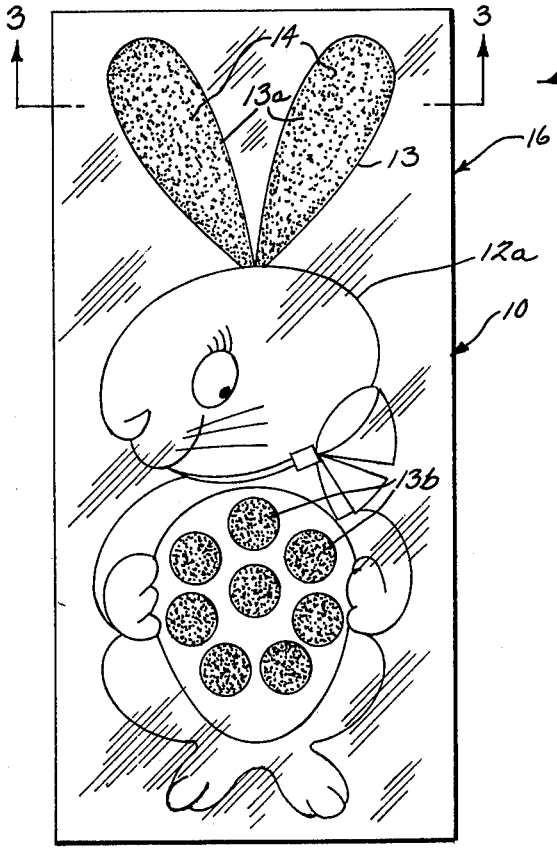
Fig.2
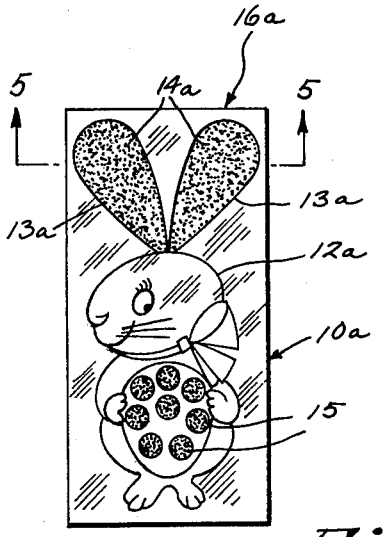
Fig.4
Fig.6
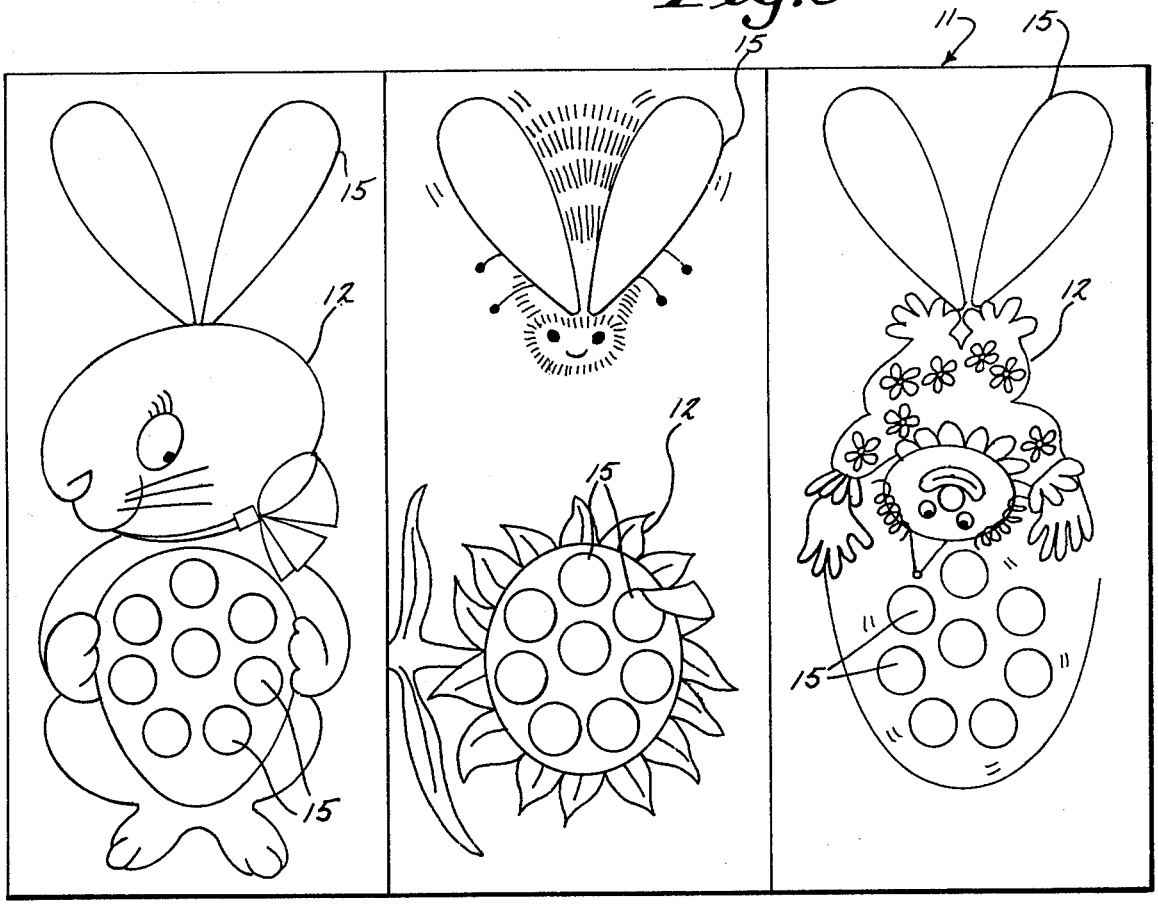

KIT FOR THREE-DIMENSIONAL PLASTIC OBJECTS

BACKGROUND OF THE INVENTION

There are currently available craft kits which contain sheets of shrinkable plastic material, and means for coloring such sheets. The kits are used to prepare attractive but, essentially two-dimensional objects. The objects are normally prepared by tracing an outline of a figure on the shrinkable plastic sheeting, if desired, coloring the figure with permanent ink markers, cutting the figure from the sheeting and heating it sufficiently to cause the plastic to shrink but not flow, and then permitting the object to cool in the shrunken form. The resulting objects are significantly smaller than the original objects and, as a result of the shrinking process, the colors appear more intense and attractive.

SUMMARY OF THE INVENTION

It is the general object of the present invention to disclose a method of preparing novel three-dimensional objects of plastic material.

It is a further object of the invention to disclose plastic sheeting adapted for use in the method of the invention which sheeting has at least a portion thereof coated with particulate material.

It has now been found that novel, three-dimensional objects can be prepared by first forming an object of shrinkable plastic sheeting having at least a portion of its surface covered by a decorative coat of particulate material, heating said object sufficiently so that the plastic shrinks but does not flow and the portion of the plastic covered with the coat of particulate material bulges or puffs outwardly, and then cooling the figure to harden the plastic to obtain a novel, three-dimensional object. In the preferred practice, the decorative coat is rayon flocking.

It is also an object of the invention to provide a kit which includes shrinkable plastic sheeting which already has a portion thereon coated with a decorative particulate material or which alternatively includes uncoated shrinkable plastic sheeting, a supply of decorative particulate material such as flocking and, if necessary, means for attaching the particulate material to the plastic sheeting.

These and still other objects of the invention will be apparent from the description which follows.

BRIEF DESCRIPTION OF THE DRAWINGS

FIG. 2 is an elevational view of an object of shrinkable plastic sheeting prior to treatment;

FIG. 4 is an elevational view of the figure of FIG. 2 after treatment;

FIG. 6 is a perspective view of a multi-figure pattern sheet.

DESCRIPTION OF THE PREFERRED EMBODIMENT

Figure 1:
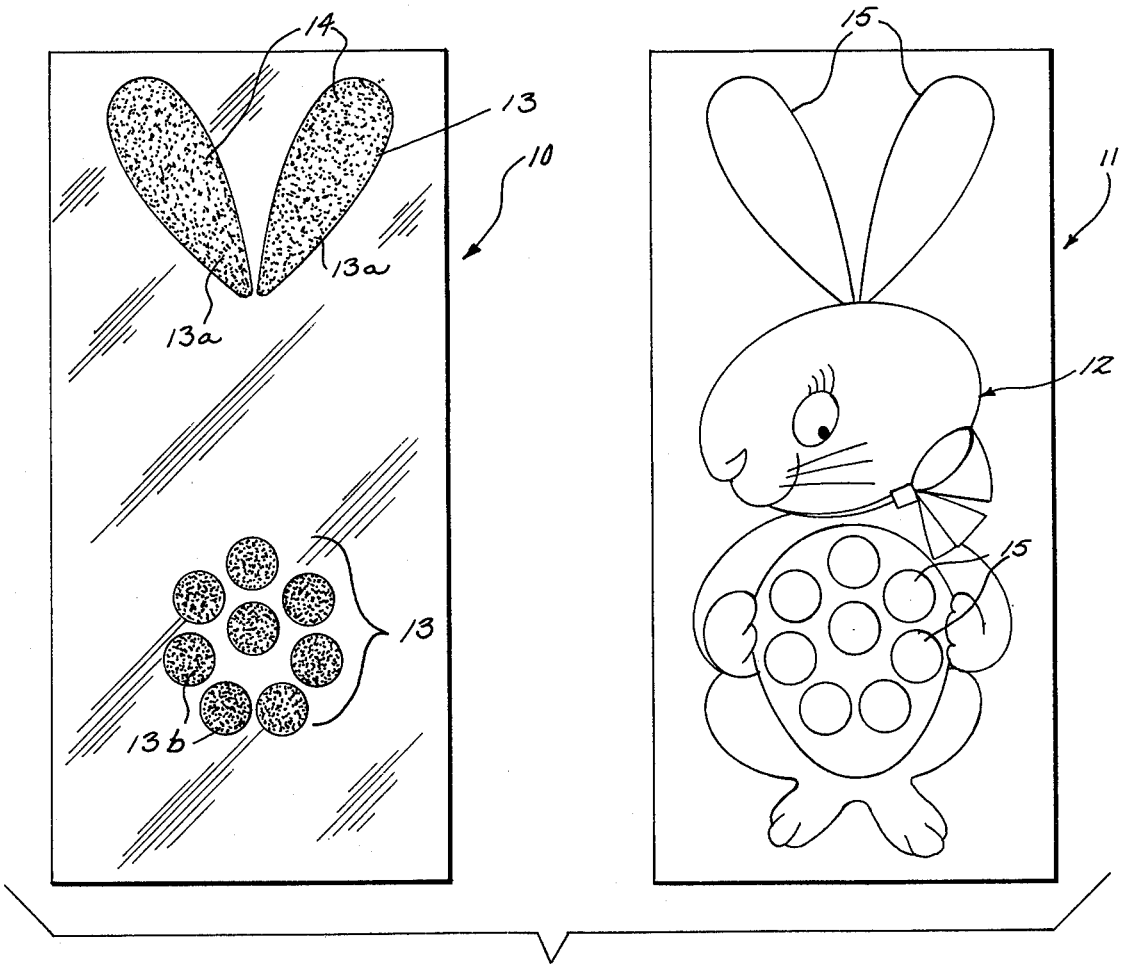
FIG. 1 is an elevational view showing a plastic sheet and a pattern sheet for use in the present invention.

Referring now to the drawings and specifically to FIG. 1, there is seen a sheet 10 of shrinkable plastic and a pattern sheet 11. The pattern sheet 11 has the outline of a figure 12 imprinted thereon and the sheet 10 has portions 13 which have thereon a coating of particulate matter 14 such as rayon flocking. The portions 13 correspond in shape to portions 15 of the figure 12. More specifically, as seen in FIG. 1, the portions 13 conform to the shape of the ears of the rabbit and the spots on the egg.

The plastic sheet 10 is preferably of biaxially orientated polystyrene sheeting of about 0.010 ml. thickness. The plastic sheet is preferably transparent or at least translucent and it may be clear white or tinted. If desired, the surface of the sheet may be smoothed or roughened. Biaxially orientated polystyrene sheeting is commercially available and has been employed in the past in kits for making two-dimensional objects of reduced size. One supplier of such kits is K-B Innovations, Inc. of Brookfield, Wisconsin which markets its product under the trademark SHRINKY DINKS. In addition to biaxially orientated polystyrene any other plastic material which possesses the property of shrinking when subjected to temperature variations may be employed in the invention.

In the preferred embodiment shown in FIG. 1, the plastic sheet 10 is sufficiently transparent so that the figure 12 on the pattern sheet can be seen through the plastic sheet 10. Thus, when the plastic sheet 10 overlies and is directly in contact with the pattern sheet 11, the figure 12 can be seen through the plastic sheet 10. The plastic sheet 10 is positioned upon the pattern sheet 11 so that the portions 13 covered with particulate material 14 overlie similarily shaped areas of the figure. 12 on the pattern sheet. In the embodiment shown in FIG. 1, the sheet 10 is positioned on the pattern sheet 11 so that the tear drop shaped flocked portions **13*a* on the plastic sheet 10 overlie the ears of the rabbit and the round dots 13*b* overlie the corresponding shaped dots on the egg shown on the pattern sheet 11. The outline and the line details of the figure 12 can then be traced upon the upper surface of the sheet 10** with a suitable device such as a permanent ink marker.

As can be seen in FIG. 2, the object 16 obtained as the result of tracing the outline and line details of the figure 12 upon the plastic sheet 10 bears a figure **12*a* which is identical to figure 12 except that the ears of the rabbit and the dots on the egg are covered by the coated portions 13*a* and 13*b*. The object 16 may then be colored; the plastic sheeting portions with permanent ink markers and the coated portions with any suitable means. If desired, the surplus plastic sheeting outside the outline of the figure 12*a*** may be cut away prior to shrink treatment.

In the method of the present invention, the object 16 of shrinkable plastic is then heated sufficiently to cause the plastic to soften and shrink but not to flow whereupon the plastic shrinks and the portions 13 coated with the particulate material bulge or puff to create a three-dimensional object of reduced size. The figure thus obtained is then hardened to retain its three-dimensional form. When a biaxially orientated polystyrene sheet of about 0.010 ml. thickness is used, the object is preferably placed on a cookie sheet or aluminum pan and then heated in a preheated oven of 300° F for about 3 minutes whereupon the plastic softens and shrinks and the area of the plastic sheeting covered with the particulate matter puffs or bulges outwardly.

In the preferred method, the object is then removed from the oven while the plastic is still soft and the areas which surround the puffed portions are flattened if necessary to exaggerate and accentuate the three-dimensional appearance.

Returning to the drawings it can be seen in FIG. 2 that the object 16 is relatively large as compared to that of FIG. 4 and is two-dimensional in form whereas the treated object 16*a* as seen in FIG. 4 is much smaller and has a three-dimensional appearance.

Figure 3:
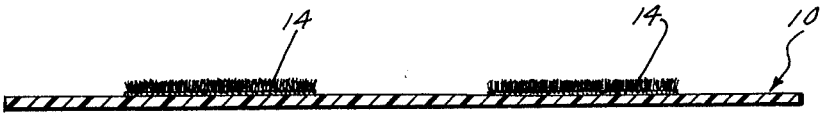
FIG. 3 is a sectional view taken along lines 3—3 of FIG. 2.
Figure 5:
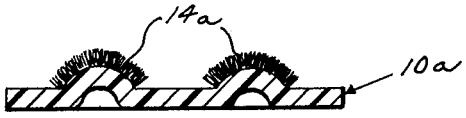
FIG. 5 is a sectional view taken along lines 5—5 of FIG. 4.

Referring now to FIGS. 3 and 5, it can be seen that prior to treatment, as seen in FIG. 3, the bottom surface of the sheet 10 immediately under the coat of particulate material 14 is flat whereas after treatment, as seen in FIG. 5, the area of the thickened sheet 10*a* under the particulate material 14*a* is definitely convex. Although it isn't known exactly why the portions of the figure coated with particulate matter puff outwardly during the heat treatment, apparently the puffing or bulging outward is due to the plastic sheeting shrinking and the particulate material having to occupy a smaller space whereupon the plastic sheeting to which it is attached is pushed into a puffed configuration.

The preferred particulate material 14 for use in the invention is rayon flocking about 0.030 inches in length which is applied to the plastic sheeting at a concentration about 1 square foot to the ounce. The flocking is preferably applied by first silk screening upon the sheeting an adhesive for the flocking; blowing the flocking upon the area of the sheet coated with adhesive so that it adheres to the adhesive and then removing the excess flocking via a vacuum system. The flocked sheet is then dried for a period of about 6–8 hours.

The adhesive used to secure the flocking to the plastic sheet is preferably a ready-to-screen flexible synthetic-type free flowing adhesive of the type normally used to apply flock to paper, cardboard, wood or any other material. One adhesive that can be used is allyl isothiocyanate in a suitable solvent such as acetone or toluene. When white rayon flocking is used, the adhesive is preferably mixed with a white pigment to add additional body to the color of the flocking.

Rayon flocking is the preferred coating material because it can be colored with ordinary coloring pencils, crayons or permanent ink markers and it also produces very attractive three-dimensional objects. Other types of finely divided particulate material which will shift with the plastic during the shrinking process and cause the plastic to bulge outwardly can be employed, e.g., metallic glitter. The particulate material must, of course, be attached to the plastic sheet in such a manner that it will not separate during the shrinking process.

Kits designed for use by young children will preferably contain plastic sheets to which the particulate material has been already attached. However, kits designed for use by older children and adults may include plain sheets or shrinkable plastic, containers of particulate material and means such as an allyl isothiocyanate adhesive for attaching the particulate matter such as flocking to the plastic sheeting.

In a preferred kit the plastic sheeting is supplied with the particulate material already coated thereon in a definite pattern and as seen in FIG. 1. The preferred plastic sheeting will usually contain more than one such pattern of particulate material so that it can be used with a multiple pattern sheet such as that seen in FIG. 6. The specially designed pattern sheets of FIG. 6 have several different figures imprinted thereon each of which has portions shaped identically to the shape of the flocked portions on the plastic sheet. The combination of the plastic sheet with a number of patterns of flocking already attached and the specially designed multiple figure pattern sheets makes the kit particularly useful for children.

The novel, three-dimensional objects prepared by the practice of the present invention are unusually attractive and can be used to make signs, key chains, mobile figures, Christmas tree ornaments and the like. Children especially enjoy the use of such kits because they can see a figure which they have prepared and colored be transformed from a relatively large two-dimensional object to a much smaller object of a three-dimensional shape.

It will be readily apparent to those skilled in the art that a number of changes and modifications may be made without departing from the spirit and scope of my invention. For example, if desired, the pattern sheet can be eliminated by printing the figure directly upon the plastic sheet in which case opaque sheeting can be employed. Alternatively, the figure can be drawn free hand on the plastic sheet about the flocked areas or drawn free hand and the flocking applied to areas of the resulting figure. It should also be understood that the conditions of the shrinking treatment can be varied and are not critical so long as the plastic object shrinks to the desired size and shape under the conditions of treatment. In view of these and other changes, it is to be understood that no limitations are to be placed upon the invention other than those set forth in the claims which follow.

I claim:

1. A kit for making a three dimensional object of plastic includes:

(a) at least one sheet of shrinkable plastic which when subjected to a suitable temperature condition will soften and shrink;

(b) a supply of particulate material which will not soften and shrink when subjected to the plastic sheet softening and shrinking temperature conditions; and (c) means for adhering the particulate material to selected portions of the plastic sheet so that when the particulate material is adhered to the plastic sheet and the plastic sheet is subjected to softening and shrinking temperature conditions the plastic sheet softens and shrinks and the selected portions of sheet coated with the particulate material bulge outwardly to form three dimension object.

2. The kit of claim 1 in which the sheet of plastic is of biaxially oriented, polystyrene which softens and shrinks when subjected to a temperature of about 300° F. for about 3 minutes.

3. The kit of claim 1 in which the particulate material is rayon flocking.

4. The kit of claim 1 which includes a pattern sheet which indicates the portions of the shrinkable plastic sheet to which the particulate material is to be adhered so that upon shrinking a definite three-dimensional object is obtained.

* * * * *